US009227288B2

(12) United States Patent
Arndt et al.

(10) Patent No.: US 9,227,288 B2
(45) Date of Patent: Jan. 5, 2016

(54) BLADE HONING APPARATUS AND CUTTING APPARATUS INCORPORATING SAME

(71) Applicant: SCA Hygiene Products AB, Göteborg (SE)

(72) Inventors: Arno Robert Arndt, Neenah, WI (US); Lon Martin King, Neenah, WI (US)

(73) Assignee: SCA HYGIENE PRODUCTS AB, Gothenburg (SE)

( * ) Notice: Subject to any disclaimer, the term of this patent is extended or adjusted under 35 U.S.C. 154(b) by 48 days.

(21) Appl. No.: 13/858,139

(22) Filed: Apr. 8, 2013

(65) Prior Publication Data

US 2014/0273761 A1 Sep. 18, 2014

Related U.S. Application Data

(60) Provisional application No. 61/786,649, filed on Mar. 15, 2013.

(51) Int. Cl.

| | |
|---|---|
| ***B24B 3/00*** | (2006.01) |
| ***B24B 3/36*** | (2006.01) |
| ***B24B 27/00*** | (2006.01) |
| ***B26D 7/12*** | (2006.01) |
| ***B24B 3/46*** | (2006.01) |

(52) U.S. Cl.

CPC . *B24B 3/36* (2013.01); *B24B 3/361* (2013.01); *B24B 3/368* (2013.01); *B24B 3/46* (2013.01); *B24B 27/0076* (2013.01); *B26D 7/12* (2013.01)

(58) Field of Classification Search

CPC ..... B24B 3/36; B24B 3/368; B26D 7/02

USPC ..... 451/45, 349, 419, 420, 422, 423

See application file for complete search history.

(56) References Cited

U.S. PATENT DOCUMENTS 2,083,069 A * 6/1937 Jones et al. ..... 451/421
2,141,055 A * 12/1938 Van Berkel ..... 451/422

(Continued)

FOREIGN PATENT DOCUMENTS

GB 925864 A 5/1963
JP 57-127653 A 8/1982

(Continued)

OTHER PUBLICATIONS

Notification of Transmittal of the International Search Report (Forms PCT/ISA/220 and PCT/ISA/210) and the Written Opinion of the International Searching Authority (Form PCT/ISA/237) issued on May 22, 2014, by the European Patent Office in corresponding International Application No. PCT/EP2014/054986. (13 pages).

*Primary Examiner* — Maurina Rachuba

(74) *Attorney, Agent, or Firm* — Buchanan Ingersoll & Rooney P.C.

(57) ABSTRACT

A honing apparatus includes a sharpening stone that has a sharpening surface configured to sharpen the edge of the blade upon engaging contact with the edge of the blade. A frame is operatively coupled to the sharpening stone, and a weight element is supported by the frame and positioned so as to urge the sharpening stone toward the edge of the blade. The frame may be pivotally coupled to a fixed element at a pivoting location, and the weight element may be positioned so as to create a moment about the pivoting location, with the moment urging the sharpening stone toward the edge of the blade.

21 Claims, 6 Drawing Sheets

(56) References Cited

U.S. PATENT DOCUMENTS

| | | | | | |
|---|---|---|---|---|---|
| 2,295,654 | A | * | 9/1942 | Gury, Jr. | 30/139 |
| 3,259,155 | A | * | 7/1966 | Kawabata | 83/13 |
| 3,503,160 | A | * | 3/1970 | Gury | 451/419 |
| 4,173,846 | A | | 11/1979 | Steiner et al. | |
| 4,347,771 | A | | 9/1982 | Bradley | |
| 5,038,647 | A | | 8/1991 | Biagiotti | |
| 5,505,108 | A | * | 4/1996 | Kuchta et al. | 83/622 |
| 5,641,321 | A | * | 6/1997 | Suzuki | 451/45 |
| 5,924,346 | A | | 7/1999 | Wunderlich et al. | |
| 8,136,434 | B2 | | 3/2012 | Casella et al. | |
| 2002/0137439 | A1 | * | 9/2002 | Hakomori et al. | 451/44 |
| 2006/0011015 | A1 | | 1/2006 | Chiocchetti et al. | |
| 2007/0026771 | A1 | * | 2/2007 | Harden et al. | 451/45 |

FOREIGN PATENT DOCUMENTS

| | | | |
|---|---|---|---|
| WO | 2004/039544 | A1 | 5/2004 |
| WO | 2013/033633 | A1 | 3/2013 |

* cited by examiner

BLADE HONING APPARATUS AND CUTTING APPARATUS INCORPORATING SAME

CROSS-REFERENCE TO RELATED APPLICATION

This application claims the filing date benefit of U.S. Provisional Application No. 61/786,649, filed Mar. 15, 2013, the entire contents of which are hereby incorporated by reference herein.

TECHNICAL FIELD

The present invention is generally related to cutting apparatus and, more particularly, to cutting apparatus including a honing or sharpening component.

BACKGROUND

In the paper industry, as well as in other industries, cutting apparatus are used for cutting logs of material. Particularly in the paper industry, cutting apparatus are used for cutting relatively long logs wound with paper, into small rolls of paper to thereby define consumer-usable rolls of toilet tissue, paper towels, or the like. One type of conventional cutting apparatus includes a rotating disc-shaped blade having a sharp cutting surface defining the perimeter of the blade. Contact of the material (e.g., logs) with the rotating sharp perimeter surface is effective to transversely cut the material. Another type of conventional cutting apparatus includes a generally rectangular, infinite length blade that moves axially i.e., in a direction along the axis of the blade. In apparatus of this latter type, the blade has one or two sharp edges, such that contact of the material with the axially-moving edge(s) is effective to transversely cut the material.

Conventional apparatus of the type described above require the respective edge(s) of the blade to be maintained in a sharp condition, capable of guaranteeing consistent, high-quality cuts. To that end, a honing device is typically placed in proximity with the edge(s) to enable periodic sharpening of the edge(s). The honing device may be mounted for periodic engagement with the edge(s), with the engagement being done manually or automatically—in response to a signal received from a sensor monitoring the condition of the blade edge(s). To that end, known honing units are mounted on an air cylinder-piston assembly, such that actuation of the air cylinder is effective to advance the sharpening surface of the honing device toward engagement with the blade edge(s) to be sharpened. Other known honing devices are mounted on a motorized leadscrew carriage such that, upon actuation of the motor, rotational output motion of the motor causes linear motion of the carriage which, in turn, causes the sharpening surface of the honing device to advance toward engagement with the blade edge(s) to be sharpened. Yet other known honing devices have complex spring-based systems that also intermittently cause engagement of the honing device with the blade edge(s) to be sharpened.

A problem with known sharpening devices of the type described above lies in the complexity of their operation, as well as in the susceptibility to breaking of the moving components of those units. Yet another problem lies in the intermittency of the engagement of the sharpening surface(s) of the honing device with the blade edge(s) to be sharpened. It is believed that this intermittency exerts high stresses on the blade edge(s) being sharpened, which results in a reduction of the useful life of the blade.

It would be desirable, therefore, to provide honing devices, and cutting apparatus incorporating same, that address these and other shortcoming of the types described above.

SUMMARY

In one embodiment, a honing apparatus is provided for use with an edge of a running blade. The honing apparatus includes a sharpening stone that has a sharpening surface configured to sharpen the edge of the blade upon engaging contact with the edge of the blade. A frame is operatively coupled to the sharpening stone, and a weight element is supported by the frame and positioned so as to urge the sharpening stone toward the edge of the blade. The frame may be pivotally coupled to a fixed element at a pivoting location, and the weight element may be positioned so as to create a moment about the pivoting location, with the moment urging the sharpening stone toward the edge of the blade.

In a specific embodiment, the frame is generally D-shaped. Additionally or alternatively, the frame may include a generally horizontally-oriented member supporting the weight element. The weight element may have a plurality of available positions respectively corresponding to a plurality of available forces for urging the sharpening stone toward the edge of the blade. In another specific embodiment, the honing apparatus includes a scale associated with the frame member that provides a measurable reference for each of the plurality of available positions. Yet in another specific embodiment, the honing apparatus includes a linkage coupled to the frame and to the sharpening stone, and the weight element urges the sharpening stone toward the edge of the blade through that linkage. In that specific embodiment, further, the weight element may exert an urging force on the sharpening stone in a direction along a longitudinal axis of the linkage.

The frame may be pivotally coupled to a fixed element at a pivoting location, and the linkage may also be pivotally coupled to that fixed element. The fixed element may be a generally vertically-oriented plate. The sharpening stone, in a specific embodiment, is configured to rotate by virtue of engaging contact with the edge of the blade. Additionally or alternatively, the frame may be pivotally coupled to a fixed element at a pivoting location. In that type of embodiment, the apparatus may further include a locking feature for fixing a position of the frame relative to the fixed element. The locking feature may have at least two available settings corresponding to two available discrete fixed positions of the frame relative to the fixed element.

In another embodiment, a cutting apparatus is provided that includes a blade having a first edge. Movement of the blade is effective to cut through a material that is in contact with the first edge. The cutting apparatus also includes a first honing apparatus for sharpening the first edge, which includes a sharpening stone having a sharpening surface configured to sharpen the first edge of the blade upon engaging contact with the first edge. A frame of the first honing apparatus is operatively coupled to the sharpening stone, and a weight element is supported by the frame and positioned so as to urge the sharpening stone toward the first edge of the blade.

In a specific embodiment, the blade has a second edge disposed opposite the first edge, with movement of the second edge being effective to cut through a material that is in contact with the second edge. In that specific embodiment, the cutting apparatus also has a second honing apparatus for sharpening the second edge of the blade, and the second honing apparatus includes a second sharpening stone having a sharpening surface configured to sharpen the second edge of the blade upon engaging contact with the second edge. A second frame of the second honing apparatus is operatively coupled to the second sharpening stone, and a second weight element is supported by the second frame and positioned so as to urge the second sharpening stone toward the second edge of the blade.

In another specific embodiment, the blade has an elongate shape, with the first edge being configured to move in a direction generally parallel to a longitudinal axis of the blade. The blade may have, for example and without limitation, a generally vertical orientation or a generally horizontal orientation. In an alternative specific embodiment, the blade has a disc shape, with the first edge being configured to rotate generally about a center of the blade.

In another embodiment, a method is provided for sharpening an edge of a moving blade with a sharpening stone. The method includes positioning the sharpening stone in engagement with the edge of the blade and positioning a weight element that is operatively coupled to the sharpening stone, so as to urge the sharpening stone toward the edge of the moving blade. Positioning the weight element may include the weight element generating a moment to thereby urge the sharpening stone toward the edge of the blade. Additionally or alternatively, positioning the weight element may include the weight element exerting an urging force on a pivoting linkage that is operatively coupled to the sharpening stone. In one specific embodiment, the method includes rotating the sharpening stone by virtue of engaging contact of the sharpening stone with the moving blade.

BRIEF DESCRIPTION OF THE DRAWINGS

The objectives and features of the invention will become more readily apparent from the following detailed description taken in conjunction with the accompanying drawings in which.

DETAILED DESCRIPTION

To the extent that any meaning or definition of a term in this written document conflicts with any meaning or definition of that term in a document incorporated by reference, the meaning or definition assigned to that term in this written document shall govern. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
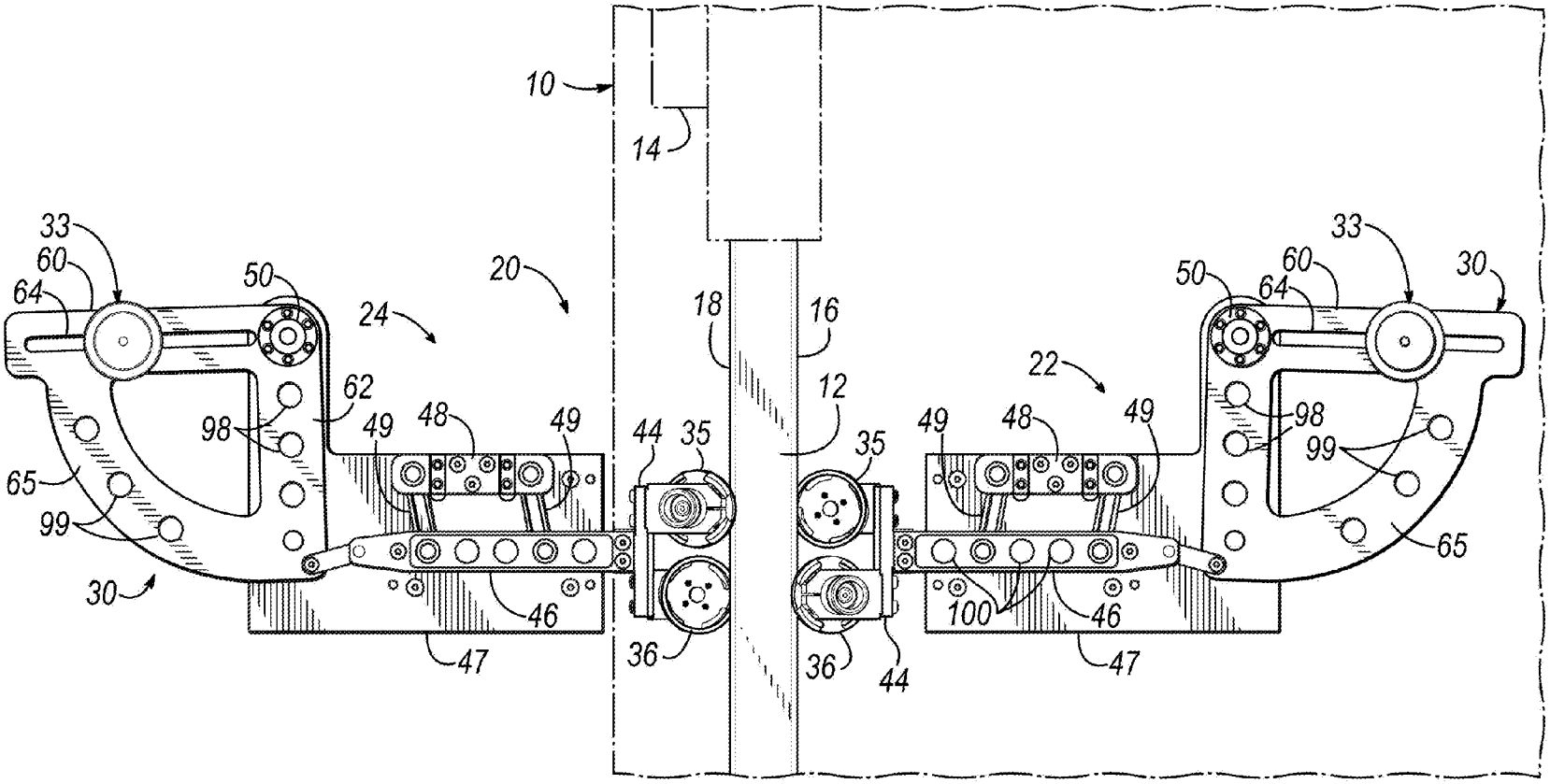
FIG. 1 is an elevation view of a cutting apparatus in accordance with one embodiment of the invention.
Figure 2:
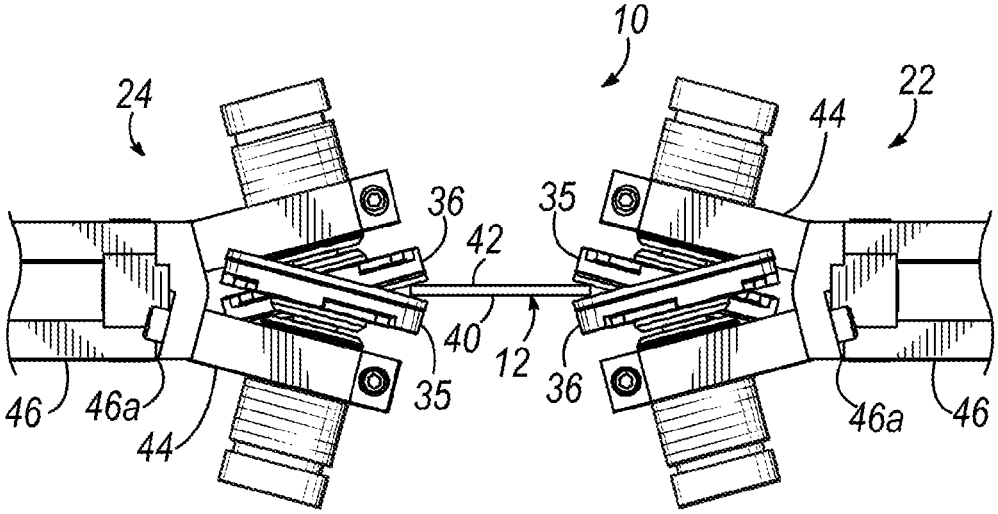
FIG. 2 is a top view of a portion of the cutting apparatus of FIG. 1.
Figure 3:
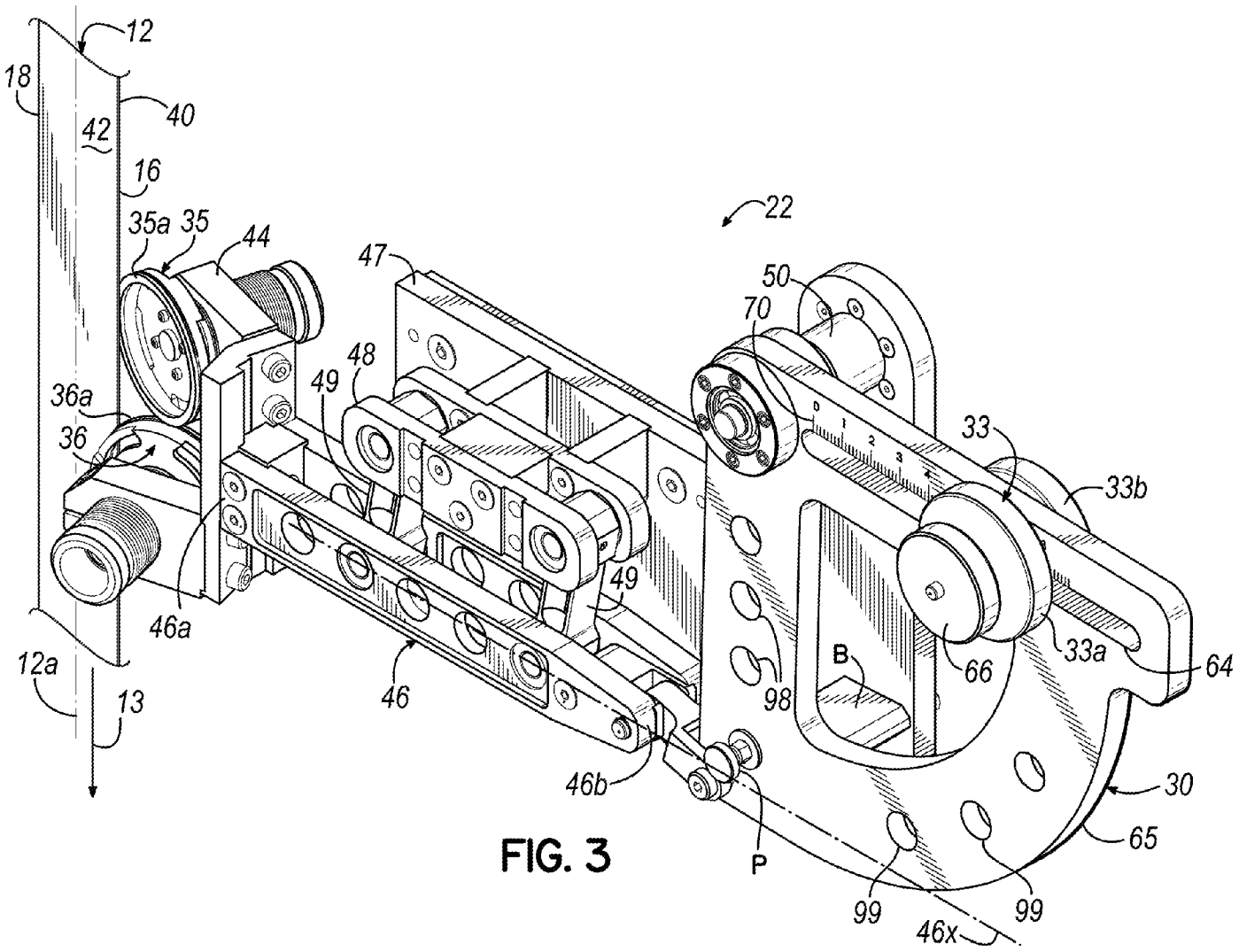
FIG. 3 is a perspective view of a honing device forming part of the cutting apparatus of FIGS. 1 and 2.

With reference to the figures, and more particularly to FIGS. 1, 2, and 3, a cutting apparatus 10 is illustrated therein. The exemplary cutting apparatus 10 is in the form of a band saw, having an infinite-length blade 12 that extends along a longitudinal axis 12*a* (FIG. 3). The blade 12 generally moves in a direction along or parallel to the axis 12*a* (arrow 13), by virtue of a sprocket 14 with which the blade 12 is frictionally engaged. More specifically, the blade 12 moves under tension and is held in tight frictional engagement with the sprocket 14 in an upper portion of the cutting apparatus 10. Axial movement of the blade 12 (arrow 13), is effective to cut through materials suitable for the type of blade being used, by virtue of engaging contact with those materials by one of opposed edges 16, 18 of blade 12. For example, and without limitation, the blade 12 may be exposed to relatively long logs of plastic or cardboard that support a wound web of a film or paper substrate. In a specific example, the blade 12 is used to cut through relatively long cardboard logs or tubes having a wound web of paper towel or toilet tissue thereon. Cutting of the relatively long log into shorter sections defines individual rolls of paper towel or toilet tissue, for example, available for consumer use.

The cutting apparatus 10 includes a sharpening or honing system, generally assigned the numeral 20, which is used to maintain the edges 16, 18 of blade 12 in sharp condition, suitable for cutting. The honing system 20 includes a pair of substantially similar honing devices or apparatus 22, 24, each configured to sharpen one of the respective edges 16, 18. For ease of explanation and understanding, any detailed description of the structure and/or functionality of honing device 22 is similarly applicable to honing device 24, while any detailed description of the structure and/or functionality of honing device 24 is similarly applicable to honing device 22.

Honing device 22 includes a frame 30, supporting a weight element 33, and a pair of rotationally-mounted sharpening or grinding stones 35, 36. Each of the grinding stones 35, 36 has a respective sharpening surface 35*a*, 36*a* (FIG. 3), oriented at a small angle relative to the plane of the blade 12. That orientation permits respective engagement of the sharpening surfaces 35*a*, 36*a* with the respective planar surfaces 40, 42 making up blade 12, at the edge 16. The grinding stones 35, 36 in the exemplary embodiment of FIGS. 1-3 are commonly mounted on a bracket 44, which is in turn coupled to the frame 30 through an elongate linkage 46, extending along a longitudinal axis 46*x*. More specifically, the bracket 44 is coupled to a first end 46*a* of linkage 46. Movement of linkage 46 in the general direction of longitudinal axis 46*x* is effective to urge the bracket 44, and thereby the grinding stones 35, 36, toward the edge 16 of blade 12. The linkage 46 is pivotally coupled to a fixed element in the form, in this exemplary embodiment, of a generally vertically-oriented metal back plate 47 of cutting apparatus 10. Linkage 46 is coupled to back plate 47 through a pair of swing arms 49 that are, in turn, pivotally coupled to the back plate 47 through a generally horizontal support 48.

With continued reference to FIGS. 1-3, the frame 30 is also pivotally coupled to the back plate 47, at a pivoting location generally assigned the numeral 50. The frame 30 is further coupled to linkage 46 at a second end 46*b* of linkage 46. In that regard, pivoting movement of frame 30 about pivoting location 50 is effective to cause axial movement of linkage 46 i.e., generally along longitudinal axis 46*x*. In this exemplary embodiment, the frame 30 is generally D-shaped, although alternative shapes are similarly contemplated. In the embodiment of FIGS. 1-3, the frame 30 includes a generally horizontally-oriented first elongate member 60, and a second elongate member 62, generally orthogonal to the first elongate member 60, with the pivoting location 50 being generally located at the intersection of elongate members 60 and 62. An arcuate third member 65 extends between the first and second elongate members 60, 62. Frame member 30 also has a spring-loaded pin P that is selectively inserted into a block B (FIG. 3) so as to lock the position of frame 30 relative to back plate 47 during maintenance and/or set-up operations. To that end, block B has two discrete openings that selectively receive the pin P. A first one of the openings (not shown) corresponds to a position of the frame 30 in which frame 30 is spaced from the blade 12 at a distance that is sufficient to allow replacement or maintenance of the blade 12. A second opening (not shown) corresponds to a position of the frame 30 closer to the blade 12, which permits set up of the angles and/or distances of the grinding stones 35, 36 relative to the planar surfaces 40, 42 of blade 12.

Figure 4A:
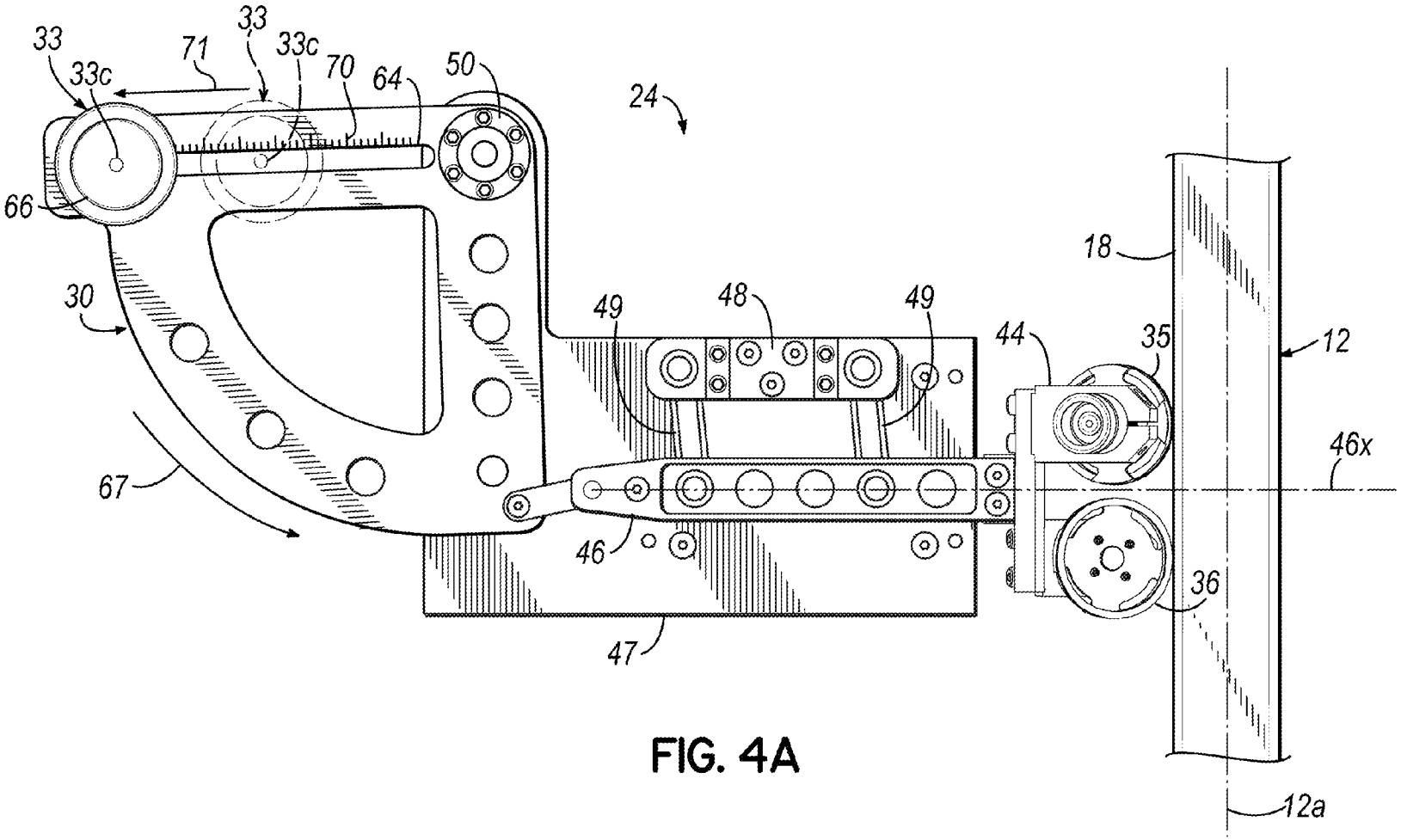
FIG. 4A is an elevation view of another honing device forming part of the cutting apparatus of FIGS. 1 and 2.

As stated above, the honing device 22 includes a weight element 33. In the exemplary embodiment of FIGS. 1-3, the weight element 33 is supported in the first elongate member 60 and is made up of a pair of cylindrical metallic portions 33*a*, 33*b*, coupled to one another through a coupling 33*c* (FIG. 4A). The cylindrical portions 33*a*, 33*b* extend from respective opposite faces of the first elongate member 60. The weight element 33 is selectively movable along substantially the entire length of first elongate member 60. More specifically, the coupling 33*c* (FIG. 4A) of weight element 33 is selectively moveable along a slot 64 of first elongate member 60, to thereby attain a plurality of available positions of weight element 33. A knob 66 defines an adjustment feature of the weight element 33 that permits tightening and loosening same against the first elongate member 60. More specifically, when a desired location of the weight element 33 along slot 64 is reached, the knob 66 is turned so as to fix the position of weight element 33 relative to frame 30. Other types of adjustment features (not shown) are alternatively contemplated, such as clamps or the like, all of which are considered to fall within the scope of the present disclosure.

Figure 4B:
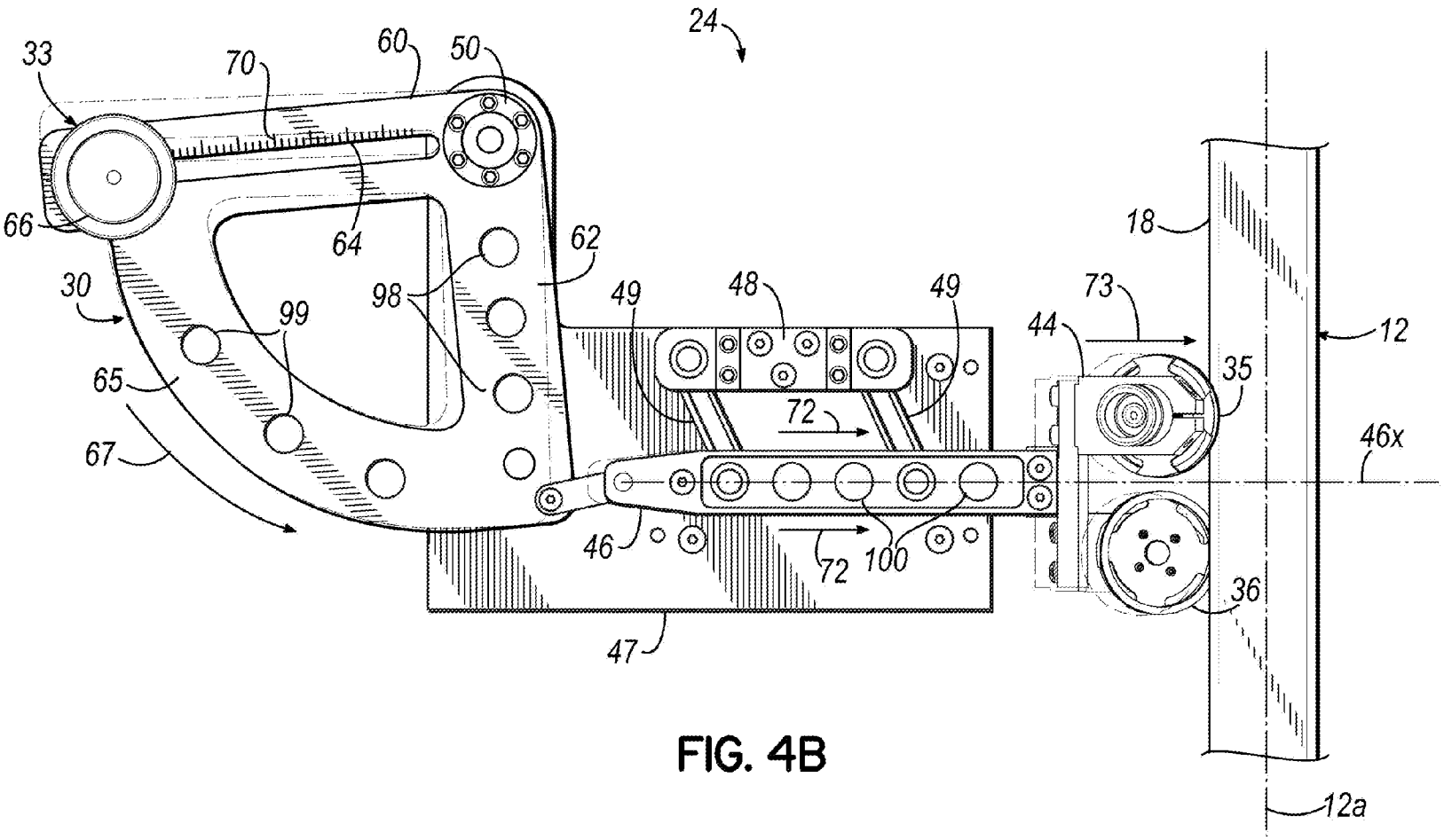
FIG. 4B is a view similar to FIG. 4A, illustrating a portion thereof in a different position from that shown in FIG. 4A.

Referring now to FIGS. 4A and 4B, those figures illustrate the honing device 24 that also forms part of honing system 20 (FIGS. 1 and 2). For ease of explanation and understanding, like reference numerals in FIGS. 4A and 4B refer to similar features in FIGS. 1-3. The weight of weight element 33 creates a torque or moment (arrow 67), about pivoting location 50, that is effective to exert a force upon linkage 46, in the general direction of longitudinal axis 46*x*. That force, in turn, is transmitted to the bracket 44 to thereby urge the grinding stones 35, 36 forward i.e., toward the edge 18 of blade 12. The position of weight element 33 along the first elongate member 60 determines the moment about pivoting location 50, and therefore directly impacts the resulting force exerted by the linkage 46 upon bracket 44. In that regard, the plurality of available positions of weight element 33 along elongate member 60 corresponds to a resulting plurality of available magnitudes of the moment and thus of the force exerted upon bracket 44, and thereby upon grinding stones 35, 36. In the exemplary embodiment of FIGS. 1-4B, the slot 64 extends past the location at which first elongate member 60 and arcuate member 65 converge, so as to maximize the number of available positions of weight element 33. While not shown, an alternative embodiment is contemplated in which the slot 64 is replaced with a plurality of discrete openings along first elongate member 60, to thereby provide weight element 33 with a plurality of available discrete positions. In the exemplary embodiment of FIGS. 4A and 4B, the slot 64 defines a continuum of available positions of weigh element 33.

With continued reference to FIGS. 4A and 4B, the first elongate member 60 includes a scale 70 thereon, to provide a measurable reference for the precise location of weight element 33 along slot 64. This scale may be desirable, for example, to enable duplication in the set-up of the honing device 24 after initial construction or after a maintenance event. Likewise, the scale 70 may be desirable in embodiments such as the one illustrated in FIGS. 1 and 2, in which two, substantially mirror-image honing devices 22, 24 are present. More specifically, the scale 70 in that exemplary embodiment permits locating the respective weight elements 33 of honing devices 22, 24 at substantially the same location along the respective first elongate member 60, to thereby exert substantially the same magnitude of urging force upon the respective sets of grinding stones 35, 36. This results in a uniform level of friction exerted by the grinding stones 35, 36 upon the respective edges 16, 18. While the scale in the illustrated embodiment is located on the first elongate member, alternatives are contemplated in which the scale has a different configuration or shape, and is located elsewhere but still in association with frame 30, so as to provide substantially the same functionality as the exemplary scale 70 of FIGS. 4A and 4B.

With particular reference to FIG. 4A, that figure illustrates the weight element 33 moving (arrow 71) from a first position (in broken lines) to a second position (in solid lines). FIG. 4B illustrates the new position of weight element 33 causing pivoting movement (counter-clockwise in that exemplary embodiment) of frame 30 about pivoting location 50, which results in a corresponding axial movement (arrows 72) of linkage 46. This, in turn, results in axial movement (arrow 73) of the grinding stones 35, 36 generally toward the center of the blade 12.

A contemplated use of the honing device 24 of the embodiments FIGS. 4A and 4B includes positioning the weight element 33 at a predetermined position along first elongate member 60, such as the position shown in broken lines in FIG. 4A. Then, after a predetermined length of time has passed or a predetermined number of manufacturing cycles have been completed, the weight element 33 may be selectively moved to another predetermined position so as to maintain a predetermined level of friction of grinding stones with the edge 18 in view of the normal wear of the edge 18 during operation. The new position may, for example, be the exemplary position of weight element 33 shown in solid lines in FIG. 4A. Movement of weight element 33 from the first to the second position may be desirable so as to maximize the useful life of the blade 12 and to provide predictability to the manufacturing operation. Additionally or alternatively, the force exerted by weight element 33 on the grinding stones 35, 36 may be also effective to cause the grinding stones 35, 36 to automatically maintain a desired level of friction on the blade 12 during the entire useful life of the blade 12. More specifically, as the edge 18 moves inwardly (i.e., toward the center of blade 12) due to normal wear in manufacturing, the weight element 33 automatically causes the grinding stones 35, 36 to also move so as to follow the changing position of the edge 18.

Figure 5:
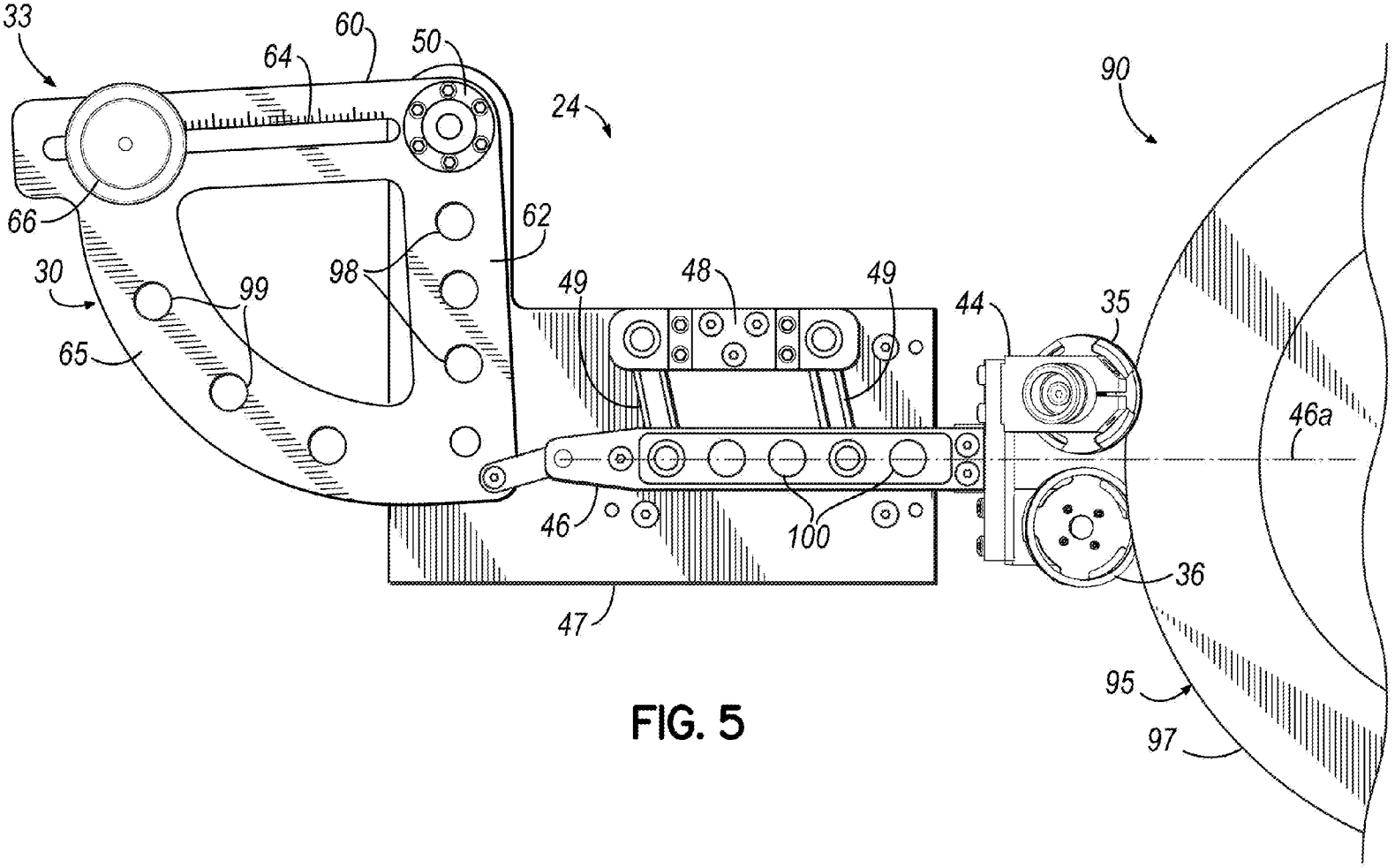
FIG. 5 is an elevation view of a portion of a cutting apparatus in accordance with another embodiment of the invention.

With reference to FIG. 5, in which like reference numerals refer to similar features in the preceding figures, a cutting apparatus 90 is illustrated. Cutting apparatus 90 also includes a honing device 24, substantially similar to the like-numbered honing devices 22, 24 of the embodiment of FIGS. 1-4B. Cutting apparatus 90 is an "orbital saw" and includes, in that regard, a disc-shaped blade 95 having an edge 97 along the perimeter of the blade 95. The edge 97 of blade 95 rotates generally about a center (not shown) of the blade 95. Engaging contact of the edge 97 with specific materials is effective to cut through those materials, and engaging contact of the grinding stones 35, 36 with rotating blade 95 is effective to sharpen edge 97.

Referring generally to the embodiments of FIGS. 1-5, the plurality of available positions of the weight element 33 permits fine adjustment of the force urging the grinding stones 35, 36 toward the edge 16, 18, 97 of the blade 12, 95—and therefore fine adjustment of the level of friction between the grinding surfaces 35*a*, 36*a* and the corresponding surfaces of the blade 12, 95. This level of control permits, in specific embodiments, running the cutting apparatus 10, 90 with the respective grinding stones 35, 36 being permanently, rather than intermittently, engaged with the blade 12, 95. More specifically, this fine level of control permits the user to optimize the level of friction in the engagement of grinding stones 35, 36 with the blade 12, 95 so as to effectively sharpen the edge 16, 18, 97 during normal operation while obviating the need to retract the grinding stones 35, 36. Further, the exemplary embodiments of FIGS. 1-5 obviate motors and the like for independent rotation of the grinding stones 35, 36. More specifically, rotation of grinding stones 35, 36 is effected by virtue of their engagement with the axial or rotational movement of the blade 12, 95 (FIGS. 1-4B and 5 respectively). In that regard, the honing device 22, 24 in certain embodiments requires fewer moving parts and has a simpler construction that conventional honing apparatus. It is contemplated, however, that other embodiments may incorporate motors or the like to effect independent rotation of the grinding stones 35, 36.

In another aspect of the exemplary embodiments of FIGS. 1-5, the honing device 22, 24 includes optional features that minimize the mass of different structural components so as attain a minimum level of force exerted upon the grinding stones 35, 36. More specifically, the second elongate member 62 and third arcuate member 65 of frame 30 in those embodiments include respective pluralities of holes 98, 99 that minimize the mass of frame 30. Likewise, in those illustrative embodiments, the linkage 46 also has a plurality of holes 100 that minimize the mass of linkage 46. Those of ordinary skill in the art will readily appreciate that other types of construction are available to minimize the mass of the various components of honing device 22, 24 without departing from the scope and spirit of the present disclosure. For example, the mass may be additionally or alternatively minimized by selecting relatively light weight materials for those components.

While the above embodiments of FIGS. 1-5 describe cutting apparatus 10, 90 having blades 12, 95 that have a general vertical orientation i.e., they lie in a generally vertical plane, it is contemplated that the honing systems may be adapted to sharpen blades that have orientations different from vertical. For example, the honing systems described herein could be adapted to sharpen blades 12, 95 that have a general horizontal orientation i.e., lying in a generally horizontal plane, or that have some other non-horizontal orientation. In the particular embodiment of FIGS. 1-4B, the bracket 44 could for example be turned about 90° so that the grinding stones 35, 36 are in a side-by-side relationship, rather than in the exemplary top-bottom relationship of the illustrated embodiments.

From the above disclosure of the general principles of the present invention and the preceding detailed description of exemplary embodiments, those skilled in the art will readily comprehend the various modifications to which this invention is susceptible. Accordingly, this invention is intended to be limited only by the scope of the following claims and equivalents thereof.

What is claimed is:

1. A honing apparatus for use with an edge of a running blade, comprising:

a sharpening stone having a sharpening surface configured to sharpen the edge of the blade upon engaging contact therewith;

a frame operatively coupled to said sharpening stone, wherein said frame is pivotally coupled to a fixed element at a pivoting location;

a weight element supported by said frame and positioned so as to rotate said frame and thereby urge said sharpening stone toward the edge of the blade, and a linkage coupled to said frame and to said sharpening stone and disposed between said frame and said sharpening stone, said weight element urging said sharpening stone toward the edge of the blade through said linkage.

2. The apparatus of claim 1, wherein:

said weight element is positioned so as to create a moment about said pivoting location, the moment urging said sharpening stone toward the edge of the blade.

3. The apparatus of claim 1, wherein said frame is generally D-shaped.

4. The apparatus of claim 1, wherein said frame includes a generally horizontally-oriented member supporting said weight element.

5. The apparatus of claim 1, wherein said weight element has a plurality of available positions respectively corresponding to a plurality of available forces for urging said sharpening stone toward the edge of the blade.

6. The apparatus of claim 5, further comprising:

a scale associated with said frame and providing a measurable reference for each of said plurality of available positions.

7. The apparatus of claim 1, wherein said weight element exerts an urging force on said sharpening stone in a direction along a longitudinal axis of said linkage.

8. A honing apparatus for use with an edge of a running blade, comprising:

a sharpening stone having a sharpening surface configured to sharpen the edge of the blade upon engaging contact therewith;

a frame operatively coupled to said sharpening stone;

a weight element supported by said frame and positioned so as to urge said sharpening stone toward the edge of the blade; and a linkage coupled to said frame and to said sharpening stone and disposed between said frame and said sharpening stone, said weight element urging said sharpening stone toward the edge of the blade through said linkage, wherein:

said frame is pivotally coupled to a fixed element at a first pivoting location, and said linkage is pivotally coupled to said fixed element at a second pivoting location offset from said first pivoting location.

9. The apparatus of claim 8, wherein said fixed element is a generally vertically-oriented plate.

10. The apparatus of claim 1, wherein said sharpening stone is configured to rotate by virtue of engaging contact with the edge of the blade.

11. A honing apparatus for use with an edge of a running blade, comprising:

a sharpening stone having a sharpening surface configured to sharpen the edge of the blade upon engaging contact therewith;

a frame operatively coupled to said sharpening stone, wherein said frame is pivotally coupled to a fixed element at a pivoting location;

a weight element supported by said frame and positioned so as to rotate said frame and thereby urge said sharpening stone toward the edge of the blade, and a locking feature for fixing a position of said frame relative to said fixed element.

12. The apparatus of claim 11, wherein said locking feature has at least two available settings corresponding to two available discrete fixed positions of said frame relative to said fixed element.

13. A cutting apparatus comprising:

a blade having a first edge, movement thereof being effective to cut through a material in contact therewith; and a first honing apparatus for sharpening said first edge, said first honing apparatus including:

(a) a sharpening stone having a sharpening surface configured to sharpen said first edge of said blade upon engaging contact therewith, (b) a frame operatively coupled to said sharpening stone, wherein said frame is pivotally coupled to a fixed element at a pivoting location, (c) a weight element supported by said frame and positioned so as to rotate said frame and thereby urge said sharpening stone toward said first edge of said blade, and (d) a linkage coupled to said frame and to said sharpening stone and disposed between said frame and said sharpening stone, said weight element urging said sharpening stone toward said first edge of said blade through said linkage.

14. The cutting apparatus of claim 13, wherein said blade has a second edge disposed opposite said first edge, movement of said second edge being effective to cut through a material in contact therewith, the cutting apparatus further comprising:

a second honing apparatus for sharpening said second edge of said blade, said second honing apparatus including:

(e) a second sharpening stone having a sharpening surface configured to sharpen said second edge of said blade upon engaging contact therewith, (f) a second frame operatively coupled to said second sharpening stone, and (g) a second weight element supported by said second frame and positioned so as to urge said second sharpening stone toward said second edge of said blade.

15. The cutting apparatus of claim 13, wherein said blade has an elongate shape, said first edge being configured to move in a direction generally parallel to a longitudinal axis of said blade.

16. The cutting apparatus of claim 15, wherein said blade has a generally vertical orientation.

17. The cutting apparatus of claim 15, wherein said blade has a generally horizontal orientation.

18. The cutting apparatus of claim 13, wherein said blade has a disc shape, said first edge being configured to rotate generally about a center of said blade.

19. The apparatus of claim 8, wherein said linkage is pivotally coupled to said frame.

20. A honing apparatus for use with an edge of a running blade, comprising:

a sharpening stone having a sharpening surface configured to sharpen the edge of the blade upon engaging contact therewith;

a frame operatively coupled to said sharpening stone;

a weight element supported by said frame and positioned so as to urge said sharpening stone toward the edge of the blade; and a linkage pivotally coupled to said frame and coupled to said sharpening stone, said linkage being between said frame and said sharpening stone, said weight element urging, with an urging force, said sharpening stone toward the edge of the blade through said linkage, said urging force being in a direction along a longitudinal axis of said linkage, wherein said frame is pivotally coupled to a fixed element at a first pivoting location, said linkage is pivotally coupled to said fixed element at a second pivoting location offset from said first pivoting location, and wherein said weight element is positioned so as to create a moment about said first pivoting location, the moment urging said sharpening stone toward the edge of the blade through said linkage.

21. A cutting apparatus comprising:

a blade having a first edge, movement thereof being effective to cut through a material in contact therewith; and a first honing apparatus for sharpening said first edge, said first honing apparatus including:

(a) a sharpening stone having a sharpening surface configured to sharpen said first edge of said blade upon engaging contact therewith, (b) a frame operatively coupled to said sharpening stone, and (c) a weight element supported by said frame and positioned so as to urge said sharpening stone toward said first edge of said blade, wherein:

said first honing apparatus includes a linkage pivotally coupled to said frame and to said sharpening stone, said linkage being disposed between said frame and said sharpening stone, said weight element urging, with an urging force, said sharpening stone toward said edge of said blade through said linkage, said urging force being in a direction along a longitudinal axis of said linkage, said frame is pivotally coupled to a fixed element at a first pivoting location, said linkage is pivotally coupled to said fixed element at a second pivoting location offset from said first pivoting location, and said weight element is positioned so as to create a moment about said first pivoting location, the moment urging said sharpening stone toward the edge of the blade through said linkage.

* * * * *